US005524310A

United States Patent [19]

Farnen

[11] Patent Number: 5,524,310

[45] Date of Patent: Jun. 11, 1996

[54] MODULAR HALFPIPE SKATEBOARD RAMP AND METHOD OF CONSTRUCTING

[76] Inventor: Mark Farnen, 259 Mt. Vernon, Grosse Pointe Farms, Mich. 48236

[21] Appl. No.: 433,972

[22] Filed: May 4, 1995

[51] Int. Cl.[6] ..... A47L 15/00

[52] U.S. Cl. ..... 14/69.5; 404/1; 472/89

[58] Field of Search ..... 404/1; 52/282.2; 472/25, 37, 38, 40, 41, 89; 14/69.5, 71.1

[56] References Cited

U.S. PATENT DOCUMENTS

| | | | |
|---|---|---|---|
| D. 256,488 | 8/1980 | Firestone | D21/242 |
| D. 258,460 | 3/1981 | Firestone | D21/244 |
| 867,330 | 1/1907 | Young | 52/750 |
| 1,091,484 | 3/1914 | Cohn | 472/89 |
| 4,129,916 | 12/1978 | Schlesinger et al. | 14/69.5 |
| 4,945,595 | 8/1990 | Meriweather | 14/69.5 |

OTHER PUBLICATIONS

Advertisement of "The Ultimate Sports Bar & Grill" featuring modular halfpipe (Jan. 12, 1984).

*Primary Examiner*—Ramon S. Britts

*Assistant Examiner*—Pamela A. O'Connor

*Attorney, Agent, or Firm*—Brooks & Kushman

[57] ABSTRACT

A portable halfpipe and method for quickly constructing the same is disclosed. The portable halfpipe includes a left arcuate module, a right arcuate module, and preferably, an intermediate planar module therebetween. Quick release connectors are used between the modules to allow the modules to be quickly connected and disconnected. Ideally, the quick release connector is a rotolock which includes a male portion having a rotatably mounted hook therein and a receiving post mounted in a cooperating female portion. The male and female portions are affixed in modules to be joined together. The engagement of the hook with the receiving post causes the modules to abut and clamp together. The method includes abutting modules together and rotating hooks to grasp receiving members thereby clamping the modules together.

15 Claims, 4 Drawing Sheets

MODULAR HALFPIPE SKATEBOARD RAMP AND METHOD OF CONSTRUCTING

TECHNICAL FIELD

This invention relates to portable halfpipes for use in skating exhibitions and entertainment.

BACKGROUND

Exhibitions of skating skill, whether it be using skateboards, conventional roller skates with four wheels, or in-line skates, are quite popular. Also, BMX cycling exhibitions are performed on halfpipes. One way in which this skill can be displayed and practiced is using a halfpipe. A halfpipe includes a generally semi-cylindrical or arcuate surface which resembles half of a pipe cut horizontally along its longitudinal axis. These halfpipes are often quite large to allow skaters to build up speed and to provide room in which to perform tricks or feats of skill. Also, it is desirable that a number of skaters can use the halfpipe at the same time.

However, the large size of halfpipes can be problematic. Portable halfpipes can be too large to placed in many venues. An example is a gymnasium which is ideally suited to seat many observers. The largest access opening to many gymnasiums includes double doors which may be approximately 7–8 feet high and 6–8 feet wide. Accordingly, many portable halfpipes cannot be placed through such a doorway opening.

Another problem conventional halfpipes have is they take a long time to assemble and disassemble. Often portable halfpipes are constructed at the performance site. Typically, a number of skating surfaces are attached on-site to a supporting structure using a large number of threaded fasteners thus taking a significant amount of time to construct the halfpipe.

Assembly time can be critical. For example, a halfpipe skating exhibition can be offered as entertainment in conjunction with other acts performing on a stage during a show. The changing of the stage for various acts necessitates rapid assembly, disassembly and movement of the halfpipe.

A further problem exits where bolted connections are made through wood, masonite or the like and are repeated, assembled and dissembled. The softer wood or masonite surfaces tend to wear out due to the repeated assembly and disassembly.

The present invention is intended to overcome the above cited shortcomings of conventional portable halfpipes.

SUMMARY OF THE INVENTION

A portable halfpipe for use by skaters and method for constructing the same is disclosed. The halfpipe comprises a left arcuate module, a right arcuate module and a releasable securing device. The left arcuate module includes a first support structure and a first arcuate track assembly having a first smooth skating portion thereon. The right arcuate module includes a second support structure and a second arcuate track assembly having a second smooth skating portion thereon. A releasable securing device preferably has a hook member and a receiving member. The hook member engages the receiving member to assist in clampingly securing the halfpipe together to form a smooth skating surface. Also, other laterally spaced arcuate modules can be used to widen the halfpiece. Similarly, intermediate planar modules can be installed between left and right arcuate modules to lengthen the module with the skating surface including a planar skating portion.

The method comprises constructing a halfpipe by providing a left half arcuate module and a right half arcuate module. The left and right half arcuate modules are aligned along a longitudinal axis. The modules are then connected relative to one another using a locking mechanism preferably having a hook member and receiving member to form a smooth continuous skating surface.

It is an object of the present invention to provide a portable modular halfpipe which can be quickly assembled and disassembled.

Another object is to provide modules which are quickly connected together using rotolocks to construct a halfpipe.

BRIEF DESCRIPTION OF THE DRAWINGS

These and other features, objects, and advantages of the present invention will become readily apparent from the following description, pending claims, and accompanying sheets of drawings where:

BEST MODE FOR CARRYING OUT THE INVENTION

Figure 1:
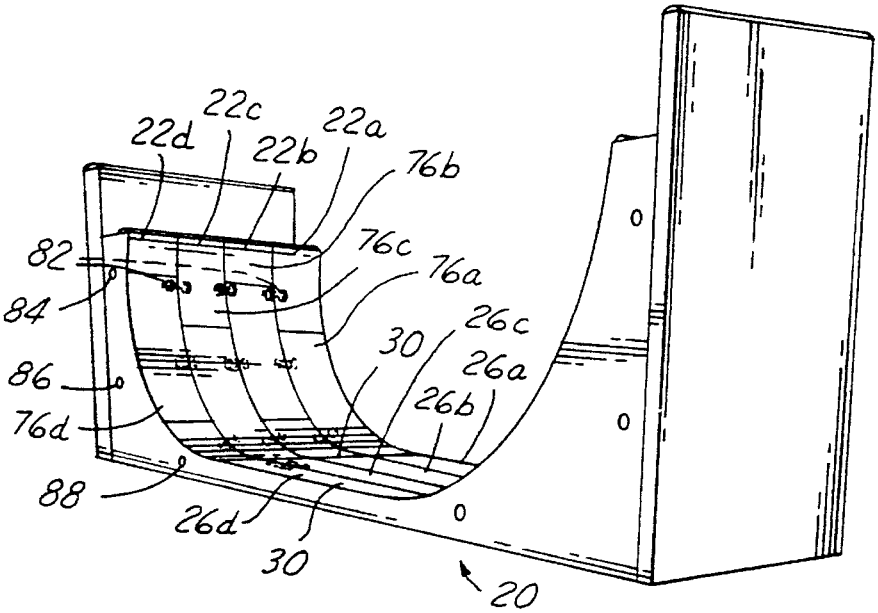
FIG. 1 is a perspective view of a portable halfpipe made in accordance with the present invention.
Figure 6:
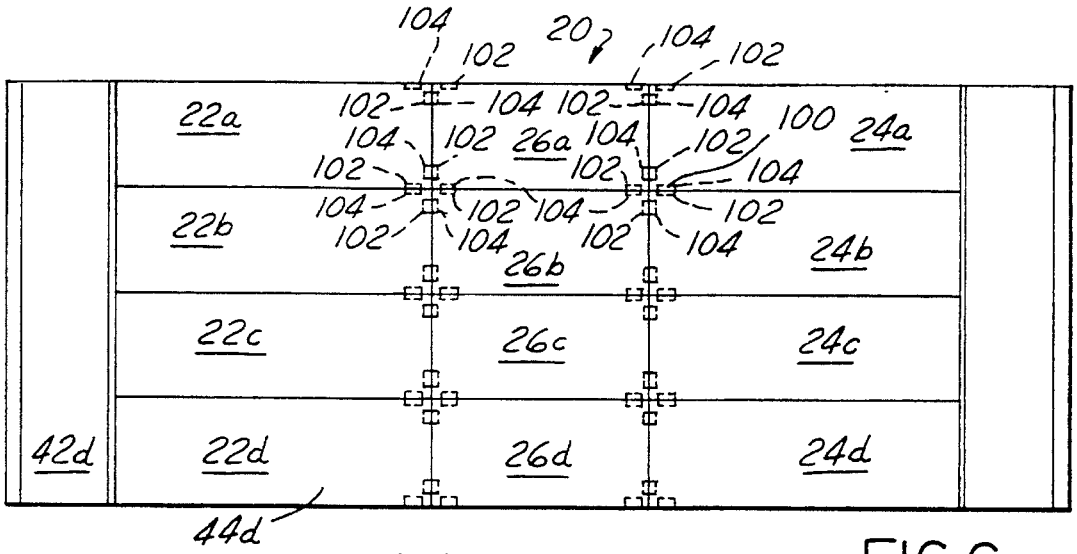
FIG. 6 is a top view of a first embodiment of the halfpipe utilizing four longitudinally extending planar modules between opposing arcuate modules.

A portable halfpipe 20, employing a plurality of modules which can be quickly assembled and disassembled, is shown in FIGS. 1 and 6. Halfpipe 20 includes four left half arcuate modules 22*a–d*, four right half modules 24*a–d* and four planar modules 26*a–d* arranged in respective longitudinally extending rows and laterally extending columns forming a 4×3 matrix. Letters *a–d* are used to designate specific modules in a column. Each respective column of four left half arcuate modules 22*a–d*, four right half arcuate modules 24*a–d* and four planar modules 26*a–d* are generally identical to other modules in that column. Left half arcuate modules 22*a–d* are laterally connected to one another forming a column of modules. Likewise, right half arcuate modules 24*a–d* are laterally connected together as are intermediate modules 26*a–d*. Further, the row of modules formed by modules 22*a* , 24*a* and 26*a* are longitudinally connected. Similarly, longitudinally aligned rows of modules 22*b–d*, 24*b–d* and 26*–b* are respectively longitudinally connected. Together, the twelve modules 22*a–d*, 24*a–d* and 26*a–d* form a smooth skating surface 30 when fastened together.

As stated previously, each of the left half arcuate modules 22*a–d* are preferably identical to one another. Each of right half arcuate modules 24*a–d* are also preferably identical to one another and are generally mirror images of left half arcuate modules 22*a–d*. Therefore, with respect to the arcuate modules, only left half arcuate module 22d will now be described in greater detail.

Figure 2:
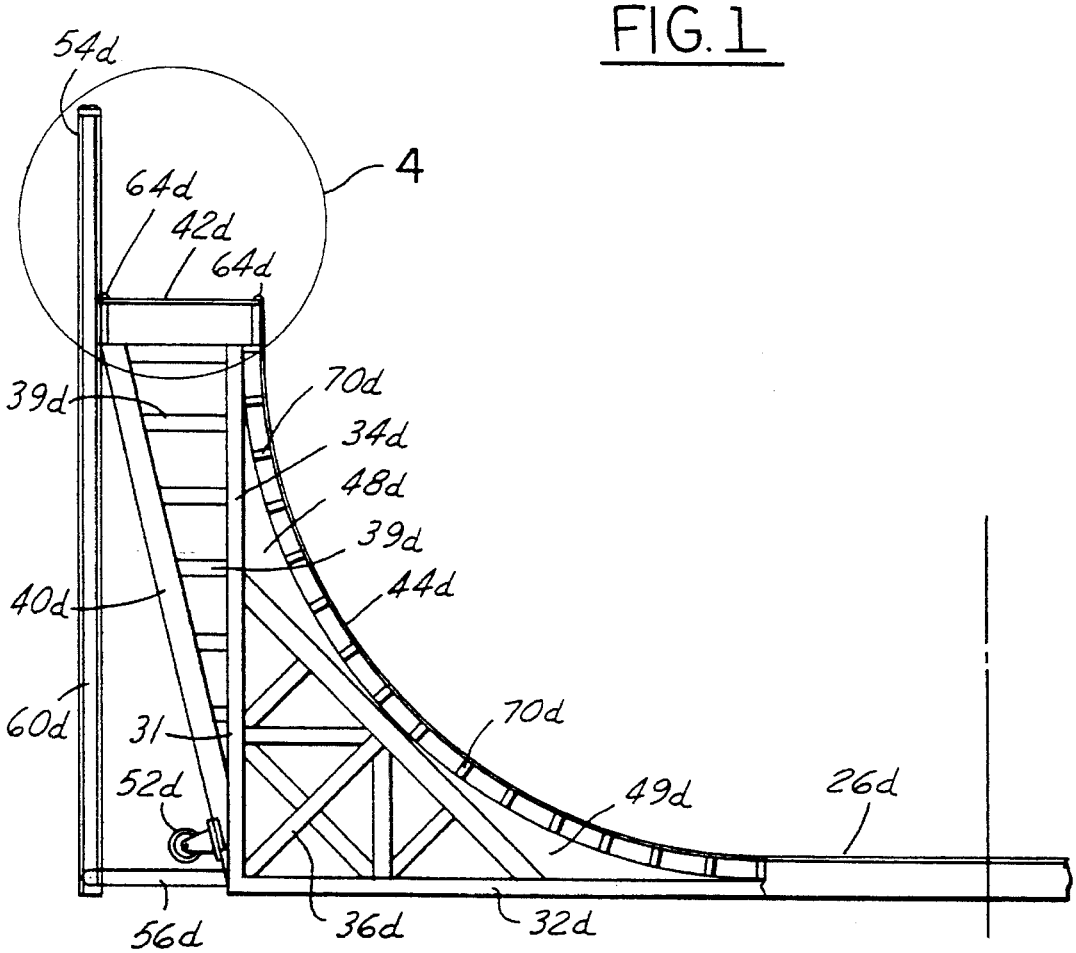
FIG. 2 is a fragmentary side view of the halfpipe of FIG. 1.

Referring now to FIG. 2, module 22*d* includes a pair of laterally spaced apart support frames 31, one of which can be seen in side view and the other hidden behind the first frame in side view. Each frame 31*d* includes a base beam 32*d* and a backing beam 34*d* which cooperate to form an L-shape. Connecting inboard between each base beam 32*d* and backing beam 34*d* is a support truss structure 36*d*, constructed generally as shown. Located outboard or rearwardly of each backing portion 34*d* are vertically spaced beams 39*d* and an inclined beam 40*d* which cooperate with backing beam 34*d* to form a triangular-shaped support structure. Preferably, the aforementioned beams are made are wood. Atop support structure 40*d* is a platform 42*d* which extends laterally between the upper ends of the frames 31*d*. Platform 42*d* provides a surface upon which skaters can stand and rest when not skating on halfpipe 20.

A laterally extending arcuate track assembly 44*d* extends between platform 42*d* and an adjacent planar module 26*d*. Arcuate track assembly 44*d* is supported at its upper end by backing beams 34*d*, at its mid-arc by support truss structure 36*d*, and at its bottom by base beam 32*d*. Pairs of plywood support panels 48*d* and 49*d* (FIG. 2) are cut to size to fill in regions between track assembly 44*d* and respective backing beams 34*d*, truss structures 36*d* and base beams 32*d* on each of the frames 31.

Figure 3:
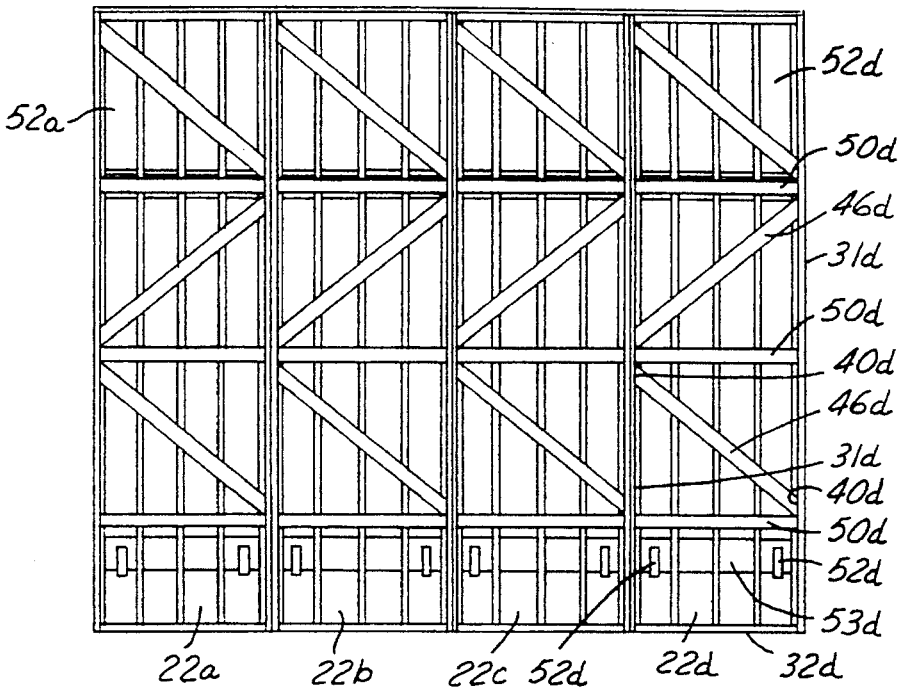
FIG. 3 is a rear view of the halfpipe.
Figure 4:
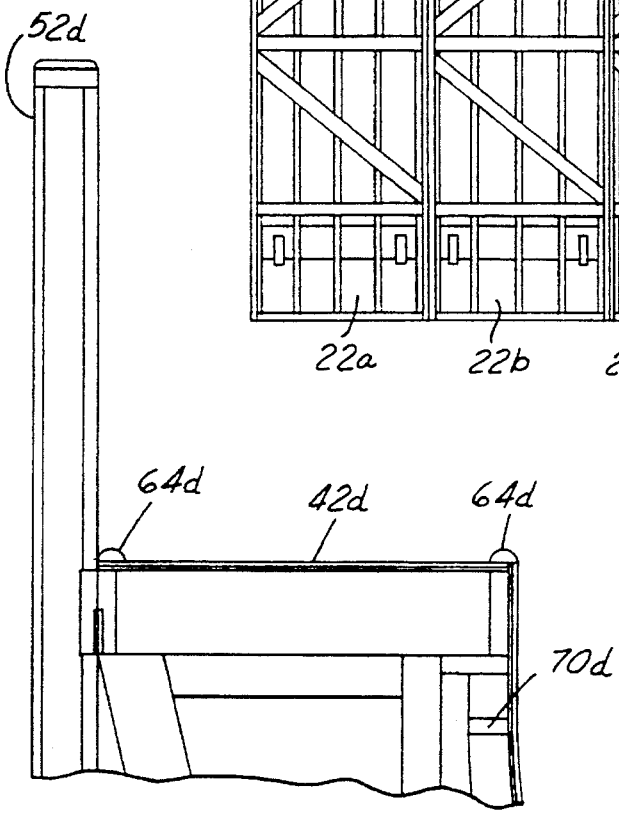
FIG. 4 is an enlarged fragmentary view of the encircled area of FIG. 2.
Figure 5:
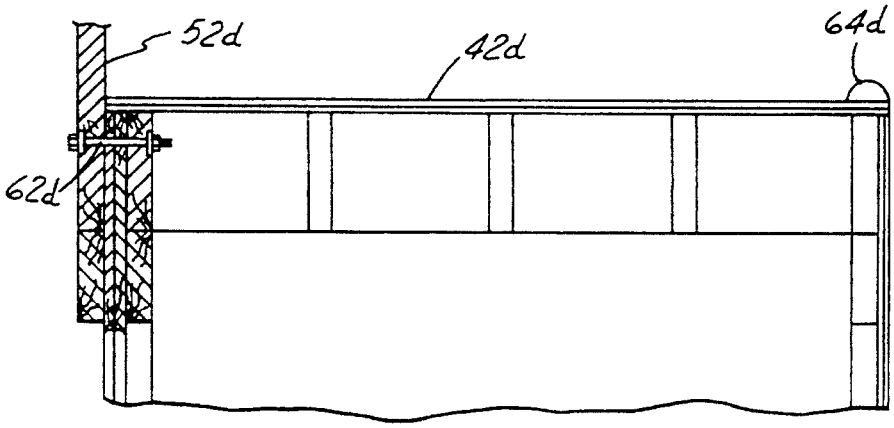
FIG. 5 is an enlarged fragmentary view of a platform upon which skaters can stand.

Referring now to FIG. 3, module 22*d* has a number of laterally extending beams including diagonal beams 46*d* which extend between inclined beams 40*d*. Cross-beams 50*d* are used at several locations to connect between frames 31*d*. A pair of laterally spaced wheels 52*d* are attached to a wheel beam 53*d* extending between inclined beams 40*d* approximately 6 inches up from base beam 32*d*. Wheels 52*d* facilitate the rolling of module 22*d* as will be further explained below.

Looking again to FIG. 2, module 22*d* includes a fence portion 54*d* which prevents skaters from falling backwards off of platform 42*d*. Fence portion 54*d* includes laterally spaced pairs of horizontal beams 56*d* and vertical beams 60*d*, only one of each pair can be seen in side view. Horizontal beams 56*d* attach pivotally at one end to backing beam 34*d* and are releasably secured by pins at their other ends to the lower ends of respective vertical beams 60*d*. The upper ends of vertical beams 60*d* preferably extends approximately 3½ feet above platform 42*d*. Platform 42*d* is ideally at a height of approximately 11 feet above a floor surface. Vertical beams 60*d* are pivotally attached to platform 42*d* to receive support therefrom. If the ends of beams 60*d* and 56*d* are released from one another, these beams can then be pivoted adjacent inclined beams 40*d* allowing module 22*d* to roll on wheels 52*d*. A pair of rubber bumpers 64*d* are attached atop platform 42*d* to provide stops for skaters. Alternatively, fence portion 54*d* can be secured to frames 31 after the rest of the module 22*d* is in place. A laterally extending backing portion 68*d* connects between vertical beams 54*d*.

Figure 8:
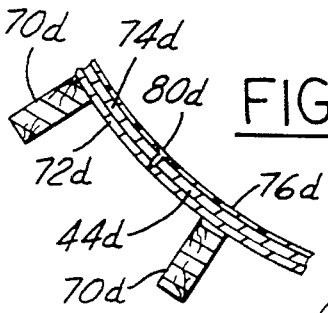
FIG. 8 is a fragmentary sectional view from an arcuate module showing the layers of a track assembly.

FIG. 8 illustrates a typical cross-section of arcuate track assembly 44*d*. Track assembly 44*d* includes circumferentially spaced and laterally extending support beams 70*d*. Support beams 70*d*, in turn, are secured to frames 31*d*. Attached to support beams 70*d* are two overlying ⅜" thick plywood sheets 72*d* and 74*d*. The thinness of the plywood sheets allows the sheets to readily conform to the necessary arcuate shape while the two thicknesses of sheets provide adequate structural support. Screws are used to semi-permanently attach the sheets 72*d* and 74*d* to support beams 70*d*. Overlying plywood sheet 74*d* is a sheet of masonite 76*d* which provides a smooth hard surface for skating, which is preferably ⅛" thick. Screws 80*d* are used to periodically affix sheet 76*d* to plywood sheets 72*d* and 74*d*. Note that the heads of screws 80*d* should be flush or below the surface of the sheet 76*d*. Although arcuate modules 22*a–d* and 24*a–d* are generally identical, it is preferred that sheets 72, 74 and 76 of the differing arcuate modules 22*a–d* have laterally extending edges which are circumferentially offset from one another so that a continuous lateral seam is not formed when the modules 22*a–d* are laterally joined. FIG. 1 illustrates the staggering of sheets 76*a–d*.

Laterally affixing the columns of modules 22*a–d* and 24*a–d* together are arcuately spaced threaded fasteners or bolts 82 which pass through circumferentially spaced apertures 84, 86 and 88 located in each of the frames 31. The bolts 82 are shown in hidden line in FIG.1. Each of apertures 84, 86 and 88 preferably has a metal collar insert (not shown) to provide a strong bearing surface to apertures 84, 86 and 88. Bolts 82 are located a substantial vertical distance above the base of the modules 22*a–d*. Apertures 84, 86 and 88 are readily accessible from the rear of the arcuate modules 22*a–d* so that the bolts 82 can be quickly installed between arcuate modules to laterally clamp the modules 22*a–d* and track assemblies 44*a–d* together. Modules 24*a–d* are similarly laterally joined together by bolted connections.

Figure 9:
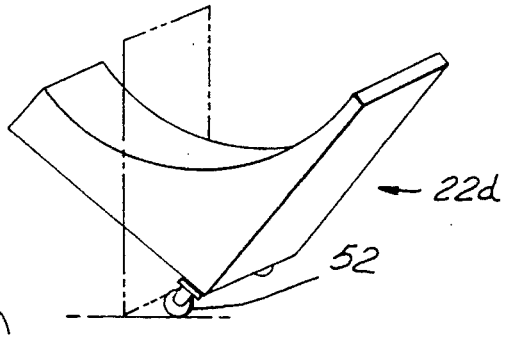
FIG. 9 is a schematic view of an arcuate module being maneuvered through a doorway.
Figure 11:
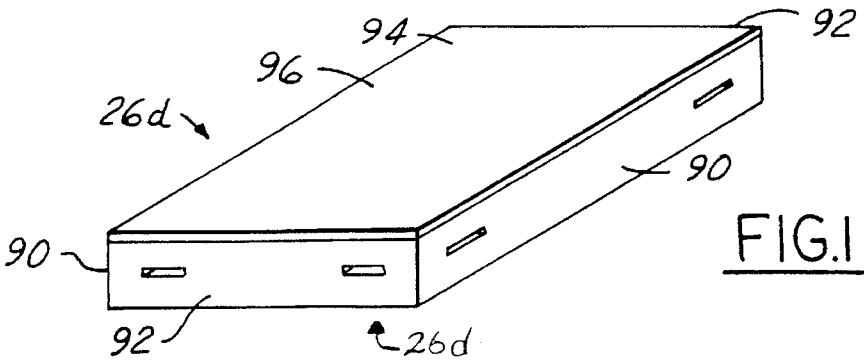
FIG. 11 is a perspective view of one of the planar modules.

FIG. 11 shows an exemplary planar module 26*d* which is typical of the other planar modules 26*a–c*. Planar module 26*d* includes a pair of longitudinally extending beams 90 and a pair of transversely extending beams 92 forming a rectangular frame. Mounted atop this frame is a track assembly 94 which is of the same generally layered configuration as track assembly 44*d* shown in FIG. 9 with exception the that track surface is planar rather than arcuate. Again, a pair of plywood sheets (not shown) support an overlying masonite sheet 96. The overall width and length of module 26*d* in this exemplary embodiment is 4'×8'. Accordingly, the arcuate modules 22*a–d* and 24*a–d* are also 4' wide.

Figure 7:
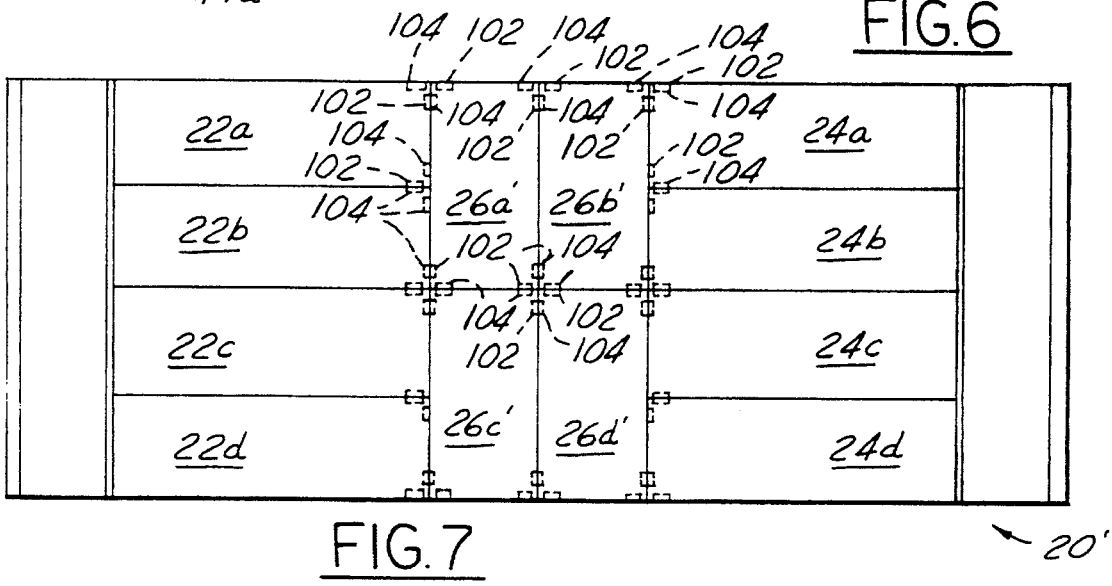
FIG. 7 is a top view of a second embodiment of the halfpipe utilizing the four planar modules between the arcuate modules but with planar modules extending laterally.

Bolting modules 22*a–d*, 24*a–d* and 26*a–d* together near a floor surface can be difficult due to space constraints. Accordingly, locking devices 100 which are readily accessible to lock and unlock modules together from the skating surface 30 are used. In this preferred embodiment rotolocks are used in modules 22*a–d*, 24*a–d* and 26*a–d* to quickly secure these components together near the base of halfpipe 20. The locations of these rotolocks is schematically shown in FIG. 7. It is within the scope of this invention to use other fastening devices which do away with the need to use threaded fasteners to connect the modules together.

Rotolocks 100 are installed in horizontally extending grooves cut into the modules 22*a–d*, 24*a–d* and 26*a–d*. In this preferred embodiment, rotolocks are male and female models SS-2-71-0074-08 and SS-2-71-0079-08 commercially available from Austin Hardware, Inc. of Minneapolis, Minn.

Figure 10:
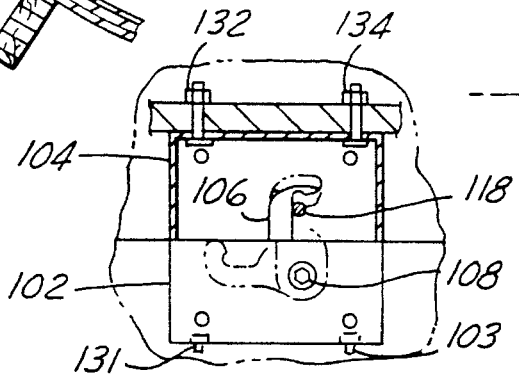
FIG. 10 is a fragmentary top view, partially cutaway, of a rotolock connecting a pair of modules together.
Figure 12:
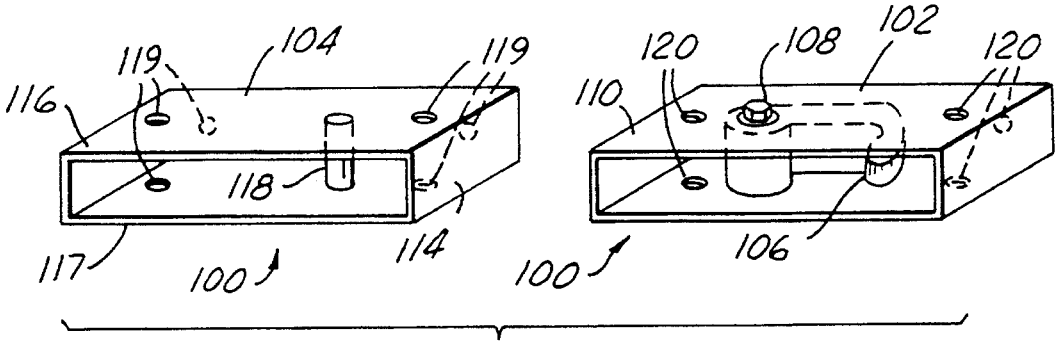
FIG. 12 is a perspective view of a connecting mechanism or rotolock including female and male portions which are used to clamp modules together.

An exemplary rotolock 100 is shown in FIGS. 10 and 12. Rotolock 100 includes a male portion 102 and a female portion 104. Male portion 102 has a housing 103 with a rotatable hook 106 mounted on a hex head screw and bearing 108. Housing 103 has a pair of plates 110 and 112 which sandwich about rotatable hook 106. Hook 106 swings in a plane between plates 110 and 112. Female portion 104 has a housing 114 with a pair of spaced apart plates 116 and 117 and a post 118 extending therebetween. Housings 103 and 114 have respective retaining apertures 119 and 120 formed therein for receiving bolts 131 and 132 to affix to respective modules.

Grooves are cut into each of the module 22*a–d*, 24*a–d* and 26*a–d*. As seen in FIG. 6, planar modules 26*a–d* have a total of four male portions 102 and four female portions 104. Each of the arcuate modules 22*a–d* and 24*a–d* have two male portions 102 and two female portions 104. Bolts 131 and 132 inserted through retaining apertures 119 and 120 hold the male and female portions 102 and 104 in place in the respective modules. Backing planks 134 are located behind each of the rotolocks to provide a structural member to which the male and female portions 102 and 104 can be bolted.

During assembly modules 22*a–d*, 24*a–d*, and 26*a –d* are individually moved. Modules are then be placed into abutting relationship as seen in FIG. 6. Hooks 106 are originally in a retracted position, as shown in phantom lines in FIG. 10. A hex wrench is then used to rotate hooks 106 into extended engagement with posts 118. When rotated into the extended position, hook 104 grasps and pulls post 120 and female portion 104 toward male portion 102. Accordingly, mating modules are tightly clamped together forming a portion of smooth skating surface 30. Because hex heads 108 are readily accessible from skating surface 30, the module of halfpipe 20 can be quickly assembled providing a smooth skating surface 30. Similarly, disassembly can be rapidly effected as well.

FIG. 7 shows an alternative embodiment of a halfpipe 20'. In this instance the elongate planar modules 26*a–d'*extend laterally rather than longitudinally. The overall longitudinal width of halfpipe 20' is the same as with halfpipe 20 of FIG. 7, i.e. 8 feet in this exemplary halfpipe.

By adding or subtracting a column of planar modules 26*a–d'*, the overall width of halfpipe 20' can be changed in increments of the width of planar modules 26*a–d'*rather than only their length. Similarly, an column of planar modules could inserted in the configuration of FIG. 7 to longitudinally lengthen halfpipe 20 an additional 8 feet. By adding two planar modules which extend laterally, the additional longitudinally length could be increased by 4' increments. The lateral width of the halfpipe can be altered by simply adding or subtracting the number of rows as desired. Also it is possible to use a combination of four longitudinally extending modules along with two laterally extending planar modules to provide a 12' long planar surface between arcuate modules.

Another, convenient aspect of the present invention is that halfpipe 20 can readily be constructed in arenas having doorways of limited size. This is accomplished by pivoting an arcuate module on its respective pair of wheels 52 to pass through a doorway which has a height which is much less than that of the erect halfpipe 20. For example, with the halfpipe 20 having arcuate modules having a platform height of approximately 11', a doorway having a height of only 8' can be passed through. The preferred width of the modules is 4'. Therefore, width is not normally a limiting constraint in passing through doorways, at least doorways having double doors.

Figure 13:
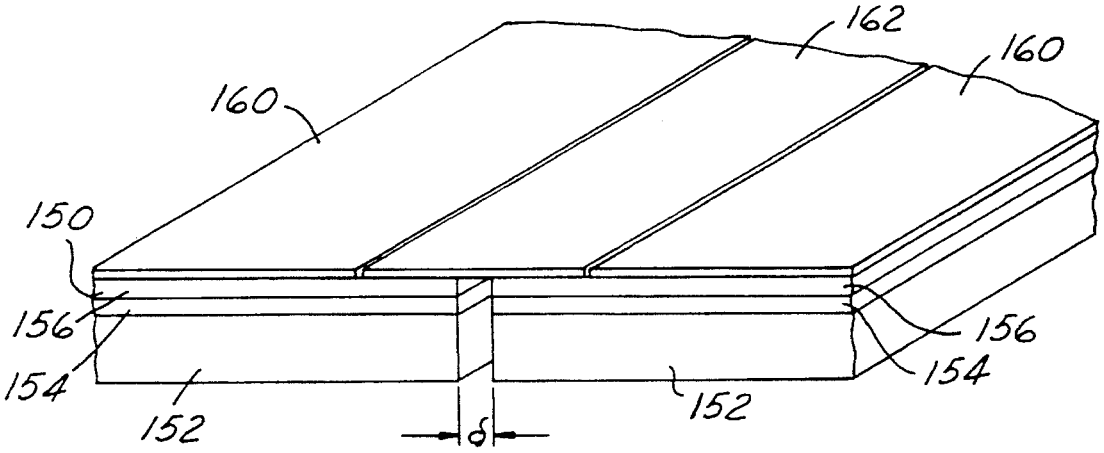
FIG. 13 is an enlarged fragmentary view of another embodiment of a halfpipe.
Figure 14:
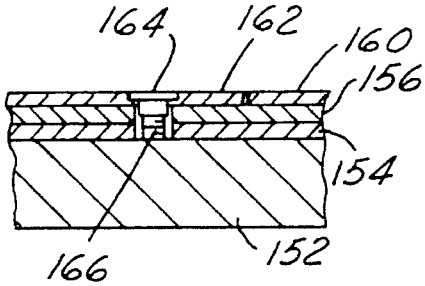
FIG. 14 is a fragmentary view of a screw attaching to a threaded anchor to join a seam sheet over a gap between modules.

If the longitudinally extending sides of the modules are not perfectly mounted, or else, the modules are not placed on flat surfaces, gaps can exist between the longitudinally extending sides of abutting columns of modules. FIG. 13 shows a solution to the gap problem. Portions of alternate track assemblies 150 are shown in FIG. 13 which can be mounted on the support structure of the modules. In this embodiment, support beams 152 are used to mount a pair of overlying plywood sheets 154 and 156 in a manner similar to support beams 70*d* described in the first embodiment. Masonite or other materials suitable for producing a smooth skating surface such as metal sheet, is mounted atop plywood sheets 154 and 156. However, in this embodiment, masonite sheet 160 is set back laterally from the opposing edges of the plywood sheets 154 and 156. For example, the set back may be 4" wide on each track assembly 150. A seam sheet 162, slightly less than 8" wide, is then used to fill in the area between the longitudinally extending edges of masonite sheets 160. This provides a cover to the gap δ found between the plywood sheets 154 and 156 on abutting modules. Screws 164 are used to fasten the masonite sheet 160 to the plywood sheets 154 and 156. A metal threaded anchor 166, such as a T-nut, may be placed into the plywood sheets 154 and 156 to reduce the chances of internal threads stripping out of the anchor 166 during repeated assembly and disassembly of seam sheet 162 to the modules.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention.

For example, to decrease weight, aluminum components could be used rather than wood. Also, indicated above, other readily accessible fastening devices could be used in place of the rotolock to effect the quick assembly and disassembly of the individuals modules without using threaded fasteners. It is also envisioned that virtually all of the threaded fasteners could be eliminated which hold frames 31 together using other fastening devices such as over center latching devices such as come-a-longs. Further, it is also possible to eliminate the use of the planar modules if there are longitudinal space constraints, thereby producing a halfpipe with only arcuate modules.

What is claimed is:

1. A portable halfpipe for use by skaters, the halfpipe comprising:

a left arcuate module including a first support structure and a first arcuate track assembly having a first smooth skating portion thereon;

a right arcuate module including a second support structure and a second arcuate track assembly having a second smooth skating portion thereon; and a releasable securing device having a hook member and a receiving member, the hook member engaging the receiving member to assist in clampingly securing the halfpipe together to form a smooth skating surface.

2. The portable halfpipe of claim 1 wherein:

the releasable securing device is a rotolock.

3. The portable halfpipe of claim 1 further comprising:

a planar module disposed between the left and right arcuate modules, the planar module including a support structure and a track assembly having a smooth planar skating portion, the skating portions of the left, right and planar modules cooperating to form a smooth skating surface aligned in a longitudinal plane.

4. The portable halfpipe of claim 3 comprising:

a plurality of right half arcuate modules, a plurality of left half arcuate modules, and a plurality of planar modules;

wherein respective left half modules, right half modules and planar modules are arranged along respective laterally extending columns and longitudinally extending rows, each row including a right half arcuate module, a left half arcuate module and a planar module disposed therebetween.

5. The portable halfpipe of claim 1 wherein:

skating portions are permanently affixed to the support structure.

6. The portable halfpipe of claim 5 wherein:

the skating portions are screwed to the support structures.

7. The portable halfpipe of claim 3 wherein:

the releasable securing device is a rotolock.

8. The portable halfpipe of claim 7 wherein:

the planar portion has four male portions and four female portions;

at least one of the arcuate modules have a rotatable hook member thereon and the other of the arcuate modules having a receiving member;

wherein the hook member and receiving member are cooperable engaged pulling the first and second skating surfaces into engagement with one another.

9. A portable halfpipe for skating exhibitions comprising:

a plurality of modules which are releasable connectable together in a matrix configuration of n×m in size, wherein n corresponds to at least two longitudinally extending rows and m corresponds at least two laterally extending columns of modules to produce an arcuate skating surface;

the plurality of modules including at least a pair of left half segments aligned laterally in columns and in abutting relationship with one another and at least a pair of right half segments aligned laterally in columns and in abutting relationship with one another, the at least a pair of left half modules disposed longitudinally with respect to the at least a pair of right half modules to form the plurality of rows;

each of the at least a pair of left and right half modules having an arcuate surface and a supporting structure therebeneath supporting the respective arcuate surface;

releasable connections to connect the rows and columns of modules together, the connections including at least one hook member and one receiving member which cooperate to clamp modules together;

wherein when the plurality of modules are connected together in the matrix configuration, the modules form a smooth skating surface.

10. The portable halfpipe of claim 9 wherein:

the modules are connectable together forming a 4×3 matrix having four rows and three columns, each row having a left arcuate module, a planar module, and right module.

11. The portable halfpipe of claim 9 wherein:

at least one row of modules includes a generally planar surface which is disposed between the left and right half arcuate modules.

12. The skating ramp of claim 9 wherein:

the connecting means includes a rotolock.

13. A method for constructing a halfpipe comprising:

providing a left half arcuate module;

providing a right half arcuate module;

aligning the left and right half arcuate module along a longitudinal plane; and connecting the modules relative to one another using a non-threaded locking mechanism to form a smooth continuous skating surface.

14. The method of claim 13 further comprising:

providing a planar module; and positioning the planar module between the left and right half modules; and connecting the arcuate modules to the planar module to form the smooth continuous skating surface.

15. The method of claim 13 wherein:

rotolocks are used as the locking mechanisms to connect the modules together.

* * * * *